US005083307A

United States Patent [19]

Meinel et al.

[11] Patent Number: 5,083,307

[45] Date of Patent: Jan. 21, 1992

[54] X-RAY RADIATOR

[75] Inventors: Fred Meinel, Eckental; Richard Eichhorn, Altendorf, both of Fed. Rep. of Germany

[73] Assignee: Siemens Aktiengesellschaft, Munich, Fed. Rep. of Germany

[21] Appl. No.: 607,467

[22] Filed: Oct. 31, 1990

[30] Foreign Application Priority Data

Nov. 9, 1989 [EP] European Pat. Off. ..... 89120808.4

[51] Int. Cl.[5] ..... H01J 35/10

[52] U.S. Cl. ..... 378/200; 378/202

[58] Field of Search ..... 378/199, 200, 201, 202

[56] References Cited

U.S. PATENT DOCUMENTS 2,457,961 1/1949 Wehmer ..... 378/200
4,384,360 5/1983 Kitadate et al. .
4,400,822 8/1983 Kuhnke et al. .
4,546,489 10/1965 Kuhnke et al. .

FOREIGN PATENT DOCUMENTS 951817 11/1949 France .
WO870378 6/1987 PCT Int'l Appl. .
577081 5/1946 United Kingdom .

*Primary Examiner*—Craig E. Church
*Attorney, Agent, or Firm*—Hill, Van Santen, Steadman & Simpson

[57] ABSTRACT

A radiator has an x-ray tube disposed in a coolant-filled housing formed by a tank and an insertable closure for the tank. The x-ray tube is provided with an asymmetrical cooling member disposed in the region of a heat exchanger. Guides are provided which effect circulation of the coolant heated at the cooling member and cooled in the heat exchanger. The coolant circulation is promoted by superimposing thermal convection in the coolant, thermal conduction in the asymmetrical cooling member, and heat flow induced by the electrical fields which are present during the normal operation of the radiator. The result is that the surface temperature of the entire x-ray radiator is substantially the same, independently of the orientation of the radiator.

17 Claims, 3 Drawing Sheets

X-RAY RADIATOR

BACKGROUND OF THE INVENTION

1. Field of the Invention

The present invention is directed to an x-ray radiator of the type having an x-ray tube contained in a housing filled with coolant, the housing being formed by a tank and an insertable closure. X-ray radiators of this type are suited for use as single-tank x-ray diagnostic generators, and contain all of the components needed to generate the x-rays.

2. Description of the Prior Art

An example of a single tank x-ray radiator is disclosed in German utility model application 81 32 991, corresponding to U.S. Pat. No. 4,546,489. In this known x-ray radiator, the x-ray tube is disposed in the proximity of a radiation exit window located in an insertable closure for a single oil-filled container or tank. Two high voltage transformers are symmetrically attached to the insertable closure next to the x-ray tube. Filament transformers for the foci of the x-ray tube are disclosed at one end of the x-ray tube. Rectifiers and high voltage capacitors are disposed symmetrically relative to the radiation exit window at the side of the x-ray tube facing away from the radiation exit side.

This known structure, during operation, achieves only a relatively low level of heat elimination, which limits the length of time that the x-ray tube can be operated as well as the operating voltages and currents of the x-ray tube. Moreover, a non-uniform heat distribution occurs, so that heat "pockets" form which, because a defined temperature within the overall radiator cannot be exceeded, result in a premature shutdown of the x-ray tube by automatic safety control circuits.

SUMMARY OF THE INVENTION

It is an object of the present invention to provide a singal tank x-ray radiator of the type described above which has improved heat elimination.

It is further object of the present invention to provide such a single tank x-ray radiator which has uniform heat distribution as the heat is dissipated.

It is another object of the present invention to provide such a single tank x-ray radiator wherein the heat elimination and distribution are substantially independent of the orientation of the radiator.

The above and other objects are achieved in accordance with the principles of the present invention in an x-ray radiator wherein the x-ray tube has a cooling member arranged in the region of a heat exchanger, and having guides which effect circulation of the coolant heated at the cooling member and cooled at the heat exchanger. The heat arising during operation of the x-ray tube can thus be transferred via the cooling member to the coolant, for example oil, contained in the x-ray radiator. Due to convection, this oil rises, causing cooler oil to be drawn to the location formerly occupied by the heated oil. The heated oil is cooled by the arrangement of the cooling member in the proximity of the heat exchanger, so that the cooled oil can then proceed back to the proximity of the cooling member of the x-ray tube.

The heat exchanger is preferably a projection of the insertable closure for the tank, the projection being provided with cooling ribs. A good elimination of heat to the ambient air is thereby achieved. Coolant circulation is further promoted by this structure.

It is preferable to arrange the high voltage transformers in the tank at that side of the x-ray tube facing away from the insertable closure. A reduction in the generation of heat by the high voltage transformers can be achieved by using transformers having cores consisting of relatively low loss material such as amorphous metal, for example, Vitrovac ®. If rectifiers and capacitors are also contained in the tank, it is preferable to dispose such rectifiers and capacitors on a printed circuit board at that side of the x-ray tube facing away from the insertable closure, for example, between the x-ray tube and the high voltage transformers. A better isolation of the x-ray tube from the other components as well as a better elimination of the heat from the x-ray tube is achieved by mounting the x-ray tube in a tube carrier, the tube carrier having openings in the region of the cooling member and at that end of the x-ray tube facing away from the cooling member. A flow of oil along the x-ray tube, which arises due to the electrical field present during operation of the tube, can then be promoted. The volume of coolant flowing pass the x-ray tube can be increased by providing the tube carrier with a rectangular cross-section.

Such a built-in x-ray tube can be subsequently adjusted, after assembly within the radiator, by providing the tube carrier with one or more threaded bores which respectively receive screws rotatably mounted in the insertable closure. A reliable mounting of the components as well as additional conduction of heat flow is achieved in an embodiment having an intermediate carrier on which the transformers and/or the printed circuit board for the capacitors and rectifiers are arranged. The intermediate carrier may have perpendicular partitions disposed in the regions of both ends of the x-ray tube. The supply voltages can be conducted to the exterior of the radiator by providing the insertable closure with an opening covered by an oil-tight plate provided with contact pins. The plate and/or the printed circuit board can be made especially oil-tight using SIL technology.

Protection against radiation leakage, and additional heat elimination, can be achieved by constructing the tube carrier of plastic, with lead plates attached thereto.

The x-ray radiator can be maintained especially oil-tight by providing steps or shoulders in the walls of the tank which engage the edges of the insertable closure, and by providing laterally disposed screws to hold the closure in place with respect to the tank.

DESCRIPTION OF THE PREFERRED EMBODIMENTS

Figure 1:
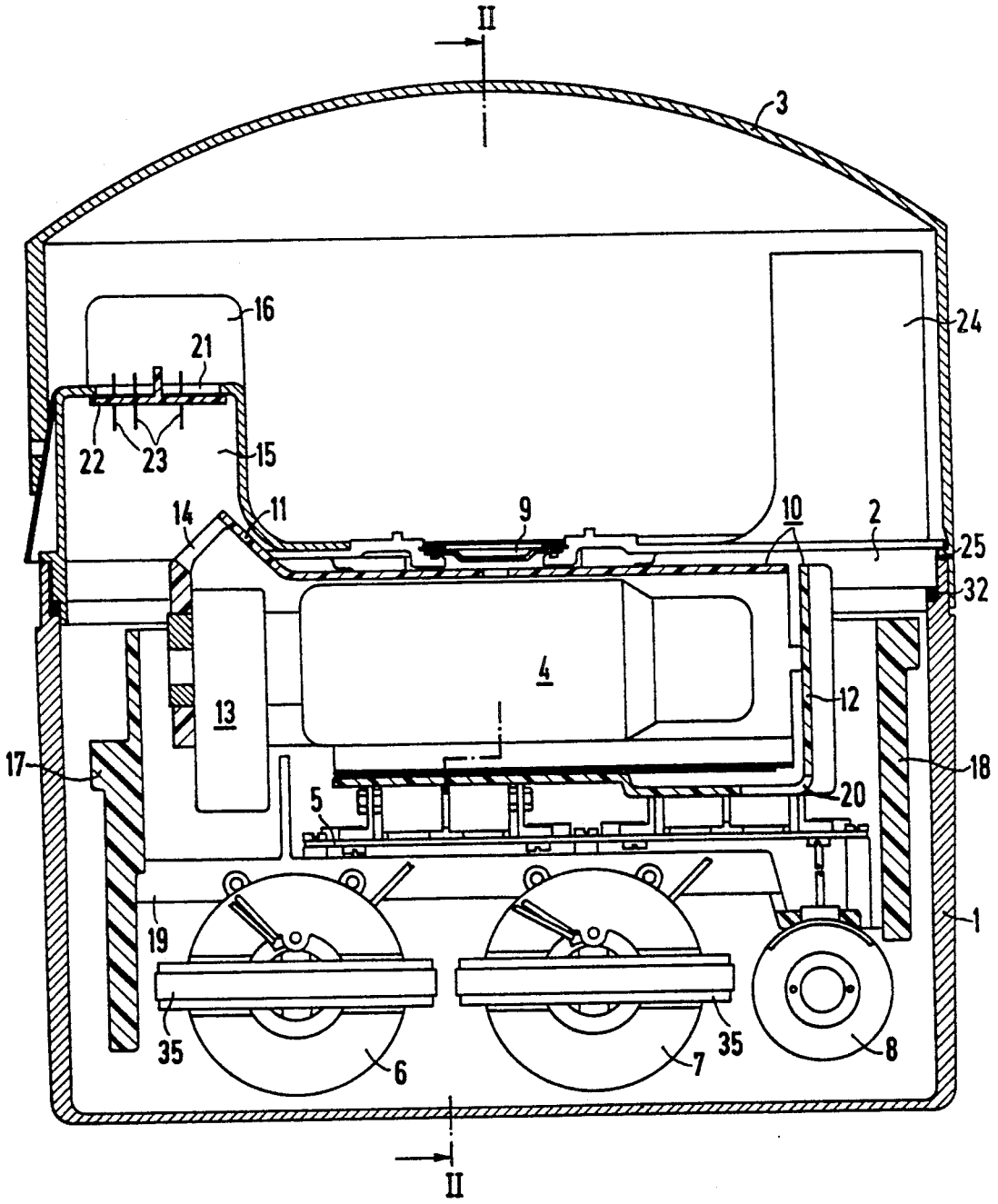
FIG. 1 is a side sectional view of an x-ray radiator constructed in accordance with the principles of the present invention.

An x-ray radiator constructed in accordance with the principles of the present invention as shown in FIG. 1 having an oil-filled housing consisting of a tank 1 and an insertable closure 2. A hood 3 covers the insertable closure 2. An x-ray tube 4, a base plate 5 having rectifiers and two high voltage transformers 6 and 7, and a filament transformer 8, are contained in the oil-filled housing.

A radiation beam exit window is disposed centrally in the insertable closure 2. A tube carrier 10, consisting of two pieces, for the x-ray tube 4 is attached to the insertable closure 2, by retaining elements 26, 27 and 28 shown in FIG. 2. One end of the x-ray tube 4 is attached to an upper part 11 of the tube carrier 10, with an asymmetrical cooling member 13 being attached to that end. The upper part 11 of the tube carrier 10 is provided with an opening 14 in the region of the cooling member 13. The tube carrier 10 is outwardly bent around the opening 14, so that the opening 14 projects into a heat exchanger 15. The heat exchanger 15 is formed by a projection of the insertable closure 2. The heat exchanger 15 is provided with cooling ribs 16.

A lower part 12 of the tube carrier 10 surrounds only the x-ray tube 4, and not the cooling member 13, so that the cooling member 13 becomes heated during operation of the x-ray tube 4 and, by convection, causes a flow of the coolant in the upward direction (given the orientation of the radiator as shown in FIG. 1). The coolant thus proceeds directly into the heat exchanger 15, and is cooled therein. Upon becoming cooled, due to the force of gravity the cooled oil descends, and is then available to receive further heat from the cooling member 13. This gravity-induced coolant circulation is conducted through a guide partition 17, which forms a part of a component carrier 19. Due to the asymmetrical cooling member 13, which is heated by thermal conduction independently of the force of gravity, the lower portion of the coolant oil is heated, and thus coolant circulation is promoted.

The lower portion 12 of the tube carrier 10 also has an opening 20 in the region of the end of the x-ray tube 4 which faces away from the cooling member 13. A gap is left between the two parts 11 and 12, so that the coolant can pass therebetween. The components carrier 19 has a perpendicularly arranged partition 18 in this region, which promotes heat circulation in that region.

Figure 2:
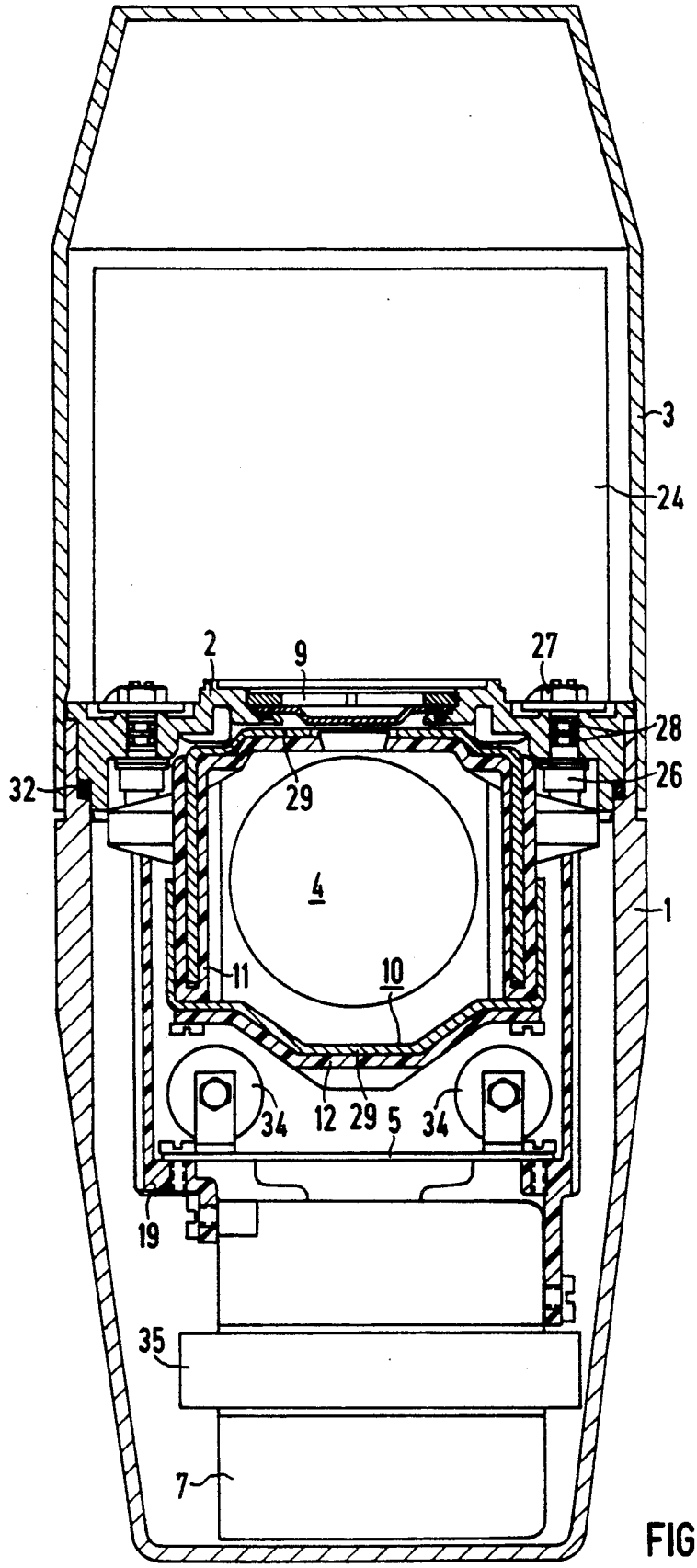
FIG. 2 is a sectional view taken along line II-II of FIG. 1.

As can be seen in FIG. 2, the tube carrier 10 has a rectangular cross-section, so that as much oil as possible can pass through the tube carrier 10 to cool the x-ray tube 4. Due to the electrical field which is generated during operation of the x-ray tube, a second coolant flow in the longitudinal direction of the x-ray tube 4 and of the tube carrier 10 arises. Cooling of the x-ray tube 4 thus ensues not only via the cooling member 13, but also via the tube bulb. A circulation and exchange of coolant is also achieved, so that the coolant which is heated at the end of the x-ray tube for away from the cooling member 13 can also proceed to the heat exchanger 15.

The printed circuit board 5 on which the high voltage capacitors 34 shown in FIG. 2 and the rectifiers (not shown) are arranged is attached to the components carrier 19 at the side of the tube carrier 10 facing away from the insertable closure 2. The high voltage transformer 6 and 7 and the filament transformer 8 are arranged beneath the printed circuit board 5. In order that the high voltage transformer 6 and 7 will operate relative loss-free and will generate only low heat, their cores 35 may consist of amorphous metal such as, for example, Vitrovac ®.

For the external connection of electrical leads, the heat exchanger 15 is provided with an opening 21 closed by a plate 22. The external connections are achieved by contact pins 23 conducted through the plate 22. The plate 22, and the printed circuit board 5, may be produced using SIL technology. In this type of fabrication a preform of plastic is produced which is subsequently coated with a layer of conductive material, which forms the solder contacts and interconnects. This structure achieves a contact lead-through which is oil-tight.

The insertable closure of the x-ray radiator may also be provided with a projection 24, at the side thereof opposite the heat exchanger 15, which can accept a pressure equalization membrane.

The tank 1 and the insertable closure 2 are covered by the hood 3 which laterally overlaps the tank 1. For retention, the hood 3, at a narrow side thereof, is provided with a detente 25 which engages a groove. The groove can be provided either in a side of the tank 1 or, as shown in FIG. 1, can be formed between the edge of the tank 1 and the insertable closure 2. At its opposite narrow side, the hood 3 overlaps the heat exchanger 15, and is connected thereto by screw 36, shown in FIG. 3.

Figure 3:
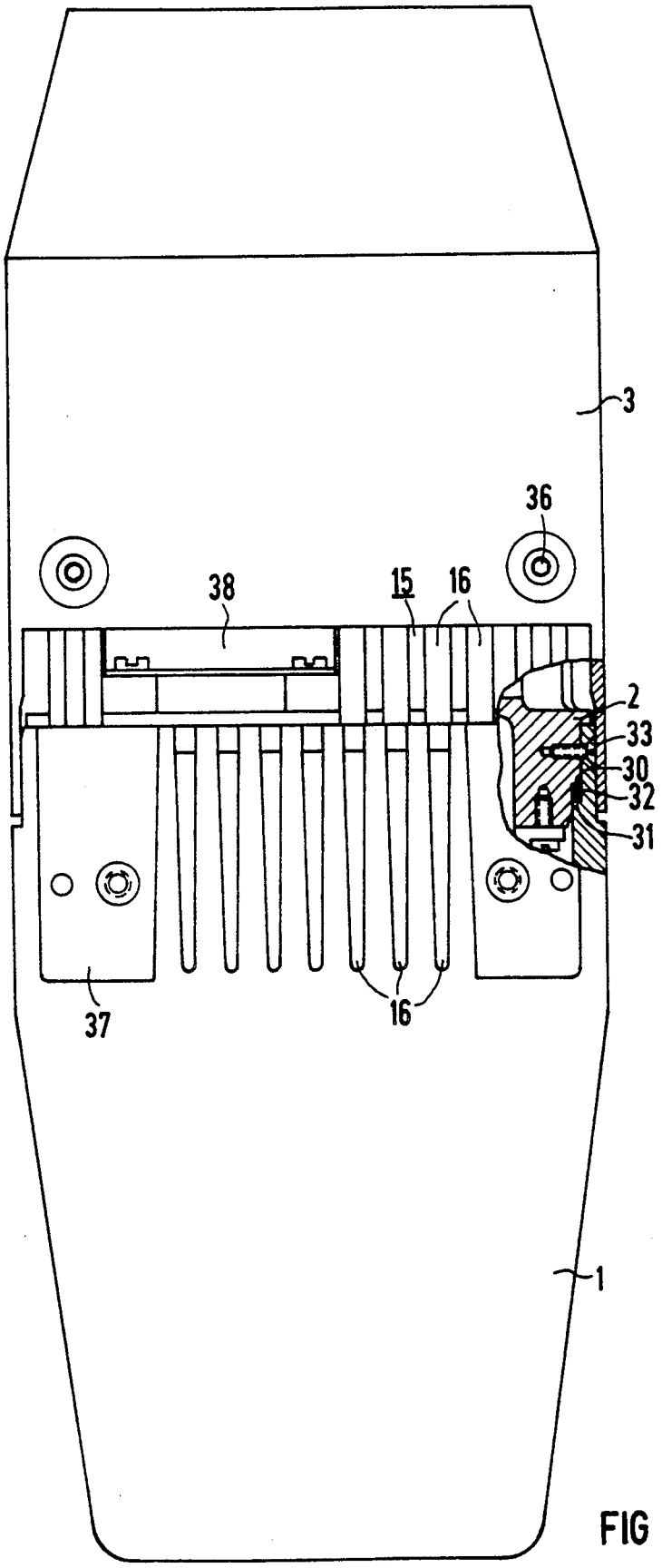
FIG. 3 is a plan view, partly broken away, showing the heat exchanger of the x-ray radiator of FIG. 1.

At the side of the tank which the heat exchanger 15 is located, the tank 1 and the hood 3 have recessed and, as shown in FIG. 3, seating surfaces 37 for a bracket for holding the x-ray radiator, for example a C-arm. Since the surfaces 37 are also in thermal communication with the heat exchanger 15, additional heat elimination from the heat exchanger 15 can occur via the bracket.

A section through the x-ray radiator of FIG. 1 along line II-II is shown in FIG. 2. It can be seen in FIG. 2 that the tube carrier 10 is connected to the insertable closure 2 by adjustable retainer elements 26, 27 and 28. The retainer elements include screws having a threaded portion engaging a threaded bore in the tube carrier 10. The screws are supported at the insertable closure by projections. The other side of each screw receives a lock nut 17. Sealing rings 28 are provided so that the bores for the screws are maintained oil-tight. By adjusting the screws of the retainer elements, the position of the tube carrier 10 and thus of the x-ray tube 4, can be adjusted relative to the insertable closure 2, because the retainer elements are rigidly connected to the insertable closure 2. The x-ray tube 4 can thus be maintained parallel to the insertable closure 2, but the distance therebetween can be adjusted, or the x-ray tube 4 can be tilted to the anode side or to the cathode side, or can be rotated around its longitudinal axis.

The tube carrier 10 may consist, for example, of plastic. For reducing radiation leakage, the carrier 10 can be provided with lead plates 29 which, for example, may engage slots in the tube carrier 10 and may be held by those slots.

As can be seen in FIG. 3, the insertable closure 2 is introduced into the tank 1 and has a step 30 which, in combination with a shoulder or ledge 31, forms a rectangular or square space in which a sealant for the coolant can be disposed. The sealant may, for example, be an O-ring 32. The O-ring 32 is pressed between step 30 and the projection 31 and the sidewalls of the insertable closure 2 and the tank 1 due to the press fit of the walls in the radial direction and the downward pressing of the insertable closure 2 in the vertical direction. The insertable closure 2 is connected to the tank 1 by a flathead or countersunk screws 33. The screws 33 extend laterally through the wall of the tank 1 into the insertable closure 2. Such lateral placement of the screws 33 insures that the pressing forces on the O-ring 32 will always be the same. The screws 33 will be covered by the hood 3 when the hood 3 is put in place, and will thus not be a disturbing factor.

A rubber seal ring can be used as the O-ring 32, which can be pre-shaped so as to matched to the rectangular shape of the x-ray radiator. Only a slight deformation of the O-ring 32 will therefore occur at its edge regions, so that there will be substantially no constriction of the O-ring 32.

The voltage feed to the contact pins 33 is shown in FIG. 3. The corresponding cables are conducted from the aforementioned bracket (not shown) through an opening 38 so that their ends can be connected, for example, to the contact pins 33 via cable receptacles. The cables can be clamped in a known way to hold them in place.

The x-ray radiator disclosed herein achieves cooling in the manner described above independent of the orientation of the radiator. If, for example, the x-ray radiator is rotated through 180° from the orientation shown in the drawings, the heat will again rise from the cooling member 13, but will first pass the partition 17 of the components carrier 19 in order to them return to the heat exchanger 15 toward the exterior, where the coolant is cooled so that it can proceed through the opening 14 back to the cooling member 13. Cooling is also achieved even if the radiator is rotated through only 90° because, in addition to being effected by gravity, the flow is also effected by the electrical field along the x-ray tube 4.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

a tank and an insertable closure forming a housing filled with coolant;

an x-ray tube attached to said insertable closure and disposed in said housing, said x-ray tube having a cooling member in thermal communication with said x-ray tube for transferring heat generated during operation of said x-ray tube from said x-ray tube to said coolant;

a heat exchanger in thermal communication with said coolant and with an exterior of said housing for transferring heat from said coolant to said exterior, said heat exchanger being formed by a projection on said insertable closure extending toward the exterior of said housing and disposed in said housing in proximity to said cooling member; and guide means disposed in said housing for effecting circulation solely by convection of said coolant heated at said cooling member and cooled in said heat exchanger.

2. An x-ray radiator as claimed in claim 1 wherein said projection has a plurality of cooling ribs in thermal communication with said coolant and said exterior.

3. An x-ray radiator as claimed in claim 1 further comprising a plurality of high voltage transformers disposed in said housing and electrically connected to said x-ray tube for operating said x-ray tube, said high voltage transformers being disposed at a side of said x-ray tube facing away from said insertable closure.

4. An x-ray radiator as claimed in claim 3 wherein said high voltage transformers have respective cores consisting of amorphous metal.

5. An x-ray radiator as claimed in claim 1 further comprising:

a printed circuit board on which a plurality of components for operating said x-ray tube are mechanically and electrically connected, said components being disposed on a side of said printed circuit board facing away from said insertable closure.

6. An x-ray radiator as claimed in claim 5 wherein said printed circuit board is an SIL board.

7. An x-ray radiator as claimed in claim 1 further comprising:

an x-ray tube carrier attached to said insertable closure and in which said x-ray tube is disposed, said cooling member being disposed at one end of said x-ray tube and said x-ray tube carrier enclosing said x-ray tube circumferentially and having openings at each end through which said coolant flows, said openings being disposed at said one end of said x-ray tube and at an opposite end of said x-ray tube.

8. An x-ray radiator as claimed in claim 7 wherein said tube carrier has a rectangular cross-section.

9. An x-ray radiator as claimed in claim 7 wherein said x-ray tube carrier is attached to said insertable closure by a plurality of screws rotatably held in said insertable closure and received in threaded bores in said carrier so that the position of said carrier can be adjusted relative to said insertable closure by rotation of said screws.

10. An x-ray radiator as claimed in claim 7 wherein said tube carrier consists of plastic, and further comprising a plurality of lead plates attached to said tube carrier.

11. An x-ray radiator as claimed in claim 1 further comprising a plurality of electrical of components contained in said housing for operating said x-ray tube and a components carrier, on which said components are mounted, attached to said insertable closure, and wherein said guide means comprise first and second partitions formed on said components carrier and extending substantially perpendicularly to said insertable closure at opposite ends of said x-ray tube.

12. An x-ray radiator as claimed in claim 1 wherein said insertable closure has an opening covered by an oil-tight plate, said plate having contact pins therein for providing electrical connections to said housing.

13. An x-ray radiator as claimed in claim 12 wherein said plate is an SIL plate.

14. An x-ray radiator as claimed in claim 1 wherein said tank has a stepped upper edge in which said insertable closure is received, and further comprising a sealant disposed between said insertable closure and said edge of said tank for preventing escape of said coolant from said housing, and a plurality of screws extending laterally through said tank for holding said insertable closure in sealed relation to said tank.

15. An x-ray radiator as claimed in claim 1 further comprising mounting means adapted for attachment to a bracket for holding said x-ray radiator disposed at an exterior of said x-ray radiator in the region of said heat exchanger.

16. An x-ray radiator as claimed in claim 1 further comprising a hood covering said insertable closure and having means for engaging said tank and holding said hood to said tank.

17. An x-ray radiator comprising:

a single oil-filled housing consisting of a tank and an insertable closure;

an x-ray tube and a plurality of electrical components for operating said x-ray tube attached to said insertable closure and disposed in said housing, said insertable closure having a radiation exit window therein and said x-ray tube being attached to said insertable closure relative to said exit window so that radiation generated by said x-ray tube passes through said exit window;

an asymmetrical cooling member disposed at one end of said x-ray tube in thermal communication therewith for transferring heat generated during the operation of said x-ray tube from said x-ray tube to said oil;

a heat exchanger formed in said insertable closure in thermal communication with said oil and with an exterior of said housing for transferring heat from said oil to said exterior, said heat exchanger disposed in proximity to said cooling member; and a plurality of guide means disposed in said housing for effecting circulation solely by convection of said oil heated at said cooling member and cooled in said heat exchanger.

* * * * *